US007306009B2

(12) United States Patent
Harvey et al.

(10) Patent No.: US 7,306,009 B2
(45) Date of Patent: Dec. 11, 2007

(54) HYDRAULIC CONTROL VALVE

(75) Inventors: John Herbert Harvey, Wolverhampton (GB); Roger Witton, Wolverhampton (GB)

(73) Assignee: Goodrich Actuation Systems Limited (GB)

( * ) Notice: Subject to any disclaimer, the term of this patent is extended or adjusted under 35 U.S.C. 154(b) by 562 days.

(21) Appl. No.: 11/006,353

(22) Filed: Dec. 7, 2004

(65) Prior Publication Data

US 2006/0191583 A1 Aug. 31, 2006

(30) Foreign Application Priority Data

Dec. 12, 2003 (GB) ..... 0328935.2

(51) Int. Cl.
*F15B 13/04* (2006.01)

(52) U.S. Cl. ..... 137/625.69; 137/312; 137/625.66; 251/356; 251/367

(58) Field of Classification Search ..... 137/312, 137/625.66, 625.69; 251/356, 367
See application file for complete search history.

(56) References Cited

U.S. PATENT DOCUMENTS 2,747,611 A * 5/1956 Hewitt ..... 137/625.69
2,994,347 A * 8/1961 Gottwald ..... 251/367
3,081,794 A * 3/1963 Lucien ..... 137/625.69
3,240,124 A * 3/1966 Howard et al. ..... 137/625.69
3,698,435 A * 10/1972 Evans ..... 137/625.69
3,757,817 A * 9/1973 Wheeler et al. ..... 137/596
3,893,484 A 7/1975 Greene
4,128,047 A * 12/1978 Caero ..... 91/420
4,860,792 A 8/1989 Ichihashi et al.
5,361,803 A * 11/1994 Stoll ..... 137/625.66
5,487,409 A * 1/1996 Stoll et al. ..... 251/367

FOREIGN PATENT DOCUMENTS

DE 33 15 056 10/1984
EP 0 860 612 8/1998

* cited by examiner

*Primary Examiner*—John Rivell
(74) *Attorney, Agent, or Firm*—Andrus, Sceales, Starke & Sawall, LLP

(57) ABSTRACT

A tandem hydraulic valve comprising first and second axially aligned valve spools, a valve guide slidably receiving said valve spools to control, in use, the connection between respective ports of the valve guide, said first and second spools being formed as separate components and being axially interconnected, to move in unison, by an axial connection component, and, the interface of said first and second spools being connected to a predefined, external, hydraulic fluid leakage path.

7 Claims, 2 Drawing Sheets

HYDRAULIC CONTROL VALVE

TECHNICAL FIELD

This invention relates to hydraulic control valves primarily, but not exclusively, for controlling hydraulic actuators for primary flight control surfaces of aircraft.

BACKGROUND ART

It is usual for the primary flight control surfaces of an aircraft, for example elevators, rudders, and ailerons, to be actuated by dual hydraulic actuators. Dual actuators can be in the form of two separate hydraulic actuators, although more often are in the form of dual-tandem actuators in which a single piston rod and output member carries two spaced pistons, each piston operating in a respective hydraulic cylinder. The two cylinders of the dual actuator arrangement are supplied separately with hydraulic fluid under pressure from respective discreet pressure sources through the intermediary of respective hydraulic control valves. The capacity of each hydraulic supply and piston and cylinder arrangement is such that the primary flight control surface can be operated by either piston operating alone, and thus the overall system can safely accommodate failure of one or other of the hydraulic supplies, control valves, or piston and cylinder arrangements.

Although the two hydraulic control valves controlling the cylinders of a dual actuator could be completely separate from one another it is essential that the cylinders of the dual actuator are operated in unison, and any lack of synchronisation in the operation of the two valves could result in an undesirable "force fight" as part of the dual actuator tries to perform an operation not being performed by the other part of the actuator. In order to avoid such difficulties a tandem control valve of the kind illustrated in FIG. 1 of the accompanying drawings has been proposed. The tandem valve of FIG. 1 includes an outer valve block 11 containing a valve body, usually referred to as a valve guide 12, slidably receiving a valve spool 13. FIG. 1 also illustrates a dual-tandem actuator 14 having first and second cylinders 15, 16 housing respective pistons 17, 18 carried by a common piston rod 19. One end of the piston rod 19 has a coupling 21 to the primary flight control surface, and the position of the piston rod 19 relative to a fixed datum position is measured by an LVDT (Linear Variable Differential Transformer) 22 or other sensor the output of which is supplied to a control system of the aircraft. In the embodiment shown the cylinders 15, 16 are fixed in position, and the actuator 14 is a double acting actuator in the sense that the piston rod 19 can be driven to the left or the right (in FIG. 1) usually to deploy or retract the associated flight control surface, by admission of hydraulic fluid under pressure to appropriate ends of the cylinders 15, 16. The invention, is applicable also in relation to single acting actuators wherein the actuator is hydraulically driven in a deploy direction and otherwise returned in the retract direction. Moreover rather than the two hydraulic circuits controlling pistons of a dual-tandem actuator they could control respective separate actuators which would thus operate in unison.

Each cylinder 15, 16 has respective flow and return lines 23*a*, 23*b* and 24*a*, and 24*b* connected to respective first and second control ports 25*a*, 25*b* and 26*a*, 26*b* of the valve guide 12. Positioned between the first and second control ports 25*a*, 25*b* is a supply port 28 connected to a first hydraulic supply line 33 for hydraulic fluid under pressure. Similarly a supply port 29 is disposed between the ports 26*a* and 26*b* and is connected to a hydraulic supply line 34 connected to a second source of hydraulic pressure. Outwardly, beyond the second control port 25*b*, the valve guide 12 has a return port 31*a*, and a second return port 31*b* is disposed between the control port 25*a* and a notional mid-plane 27 of the valve guide 12. The return ports 31*a* and 31*b* are connected to a common low pressure return line 35. The valve guide to the right of the plane 27 (the guide of the right-hand control valve of the tandem valve) is similarly provided with first and second return ports 32*a*, 32*b* connected to a common low pressure return line 36.

The spool 13 of the tandem valve can be viewed as two integral spools, one for each valve, and each has a centrally disposed gallery 43, 46 which, dependent upon the axial position of the spool, can connect the respective supply ports 28, 29 to one or other of the respective first and second control ports 25*a*, 25*b* and 26*a*, 26*b*. On opposite sides of each centre gallery 43, 46 the spool is provided with first and second return galleries 44*a*, 44*b* and 47*a*, 47*b*.

When supply gallery 43 interconnects supply port 28 and control port 25*a* then return gallery 44*b* interconnects return port 31*b* and control port 25*b*. Similarly with the spool moved in the opposite direction, to the right, and supply gallery 43 connects supply port 28 and control port 25*b* then return gallery 44*a* interconnects return port 31*a* and control port 25*a*. Moreover, it will be understood that while gallery 43 interconnects ports 28 and 25*a*, the supply gallery 46 will be interconnecting supply port 29 with control port 26*a* and return gallery 47*b* will be connecting return port 32*b* with control port 26*b*. Similarly when supply gallery 46 interconnects supply port 29 with control port 26*b* then return gallery 47*a* connects return port 32*a* and control port 26*a*.

It will be recognised therefore that with the tandem valve in the position shown in FIG. 1 the lands of the spool which separate the gallery 43 from the gallery 44*a* and the gallery 43 from the gallery 44*b*, are in position closing the control ports 25*a* and 25*b*. At the same time the lands at the right hand end of the spool 13 close the control ports 26*a*, 26*b*, and both cylinders 15 and 16 have their pistons 17, 18 hydraulically locked in position so that the piston rod 19 is immovable, there being no flow path along the hydraulic lines 23*a*, 23*b* and 24*a*, 24*b*.

Movement of the spool 13 to the left from the position shown in FIG. 1 supplies hydraulic fluid under pressure from the supply line 33 to the left-hand side of the piston 17, while opening the line 23*b* from the right-hand side of the piston to the low pressure return line 35. Simultaneously, and in synchronism therewith, the left-hand side of the piston 18 is exposed to hydraulic pressure from the supply line 34 through the line 24*a*, and the right-hand side of the piston 18 is connected to the low pressure return line 36 through the line 24*b*. Thus the piston rod 19 is moved to the right to deploy the primary flight control surface.

Movement of the spool 13 to the right, through the full extent of its travel, reverses the connections to the lines 23*a*, 23*b*, and 24*a*, 24*b* so that the right-hand sides of the pistons 17, 18 are exposed to hydraulic pressure from the supply lines 33 and 34 while the left-hand sides of the pistons 17, 18 are connected to the low pressure return lines 35 and 36 respectively, thereby driving the piston rod 19 to the left and retracting the associated primary flight control surface.

Each of the ports 25, 26, 28, 29, 31, 32 is defined in the valve guide 12 by a circumferential, rectangular cross-section groove in the outer surface of the valve guide. The grooves are closed so as to define annular galleries by the inner surface of the valve block 11. The wall of the guide 12 has a plurality of radial drillings extending inwardly from the channels defining the various ports, and opening at the inner face of the guide 12 to coact with the galleries of the spool 13. The spool 13 is moved within the guide 12 by the application of pressurised hydraulic fluid to control chambers 38, 39 at opposite ends respectively of the spool 13. Application of pressure to the chamber 38 while venting the chamber 39 moves the spool 13 to the right in FIG. 1 against the action of a return spring 41, while application of control pressure to the chamber 39 while venting the chamber 38 moves the spool to the left against the action of a further return spring 42.

It can be seen that at each side of each annular port defined between the guide 12 and the valve block 11 there is provided an "O"-ring seal which seals the interface of the guide 12 and the valve block 11 to prevent leakage along that interface. Furthermore, the large central land of the spool 13, between the galleries 44*b* and 47*a*, is provided with an 'O'-ring seal sealing the sliding interface of the spool 13 and the guide 12 to prevent leakage between the galleries 44*b* and 47*a* along that interface. It will be recognised that it is most important, for safety considerations, to preserve the isolation of the two hydraulic systems and in normal operation the arrangement, including the 'O'-ring seals, achieves such isolation of the systems from one another. However, it has been recognised that there is a possible fault condition of the tandem valve of FIG. 1 in which the spool 13 fractures along a line joining the gallery 44*b* and the gallery 47*a*. Such a fracture line is shown at 50 in FIG. 1 and could cause leakage from the gallery 44*b* to the gallery 47*a* and vice versa leading to cross contamination of the two separate hydraulic systems and possible undesirable pressurisation or loss of pressurisation of a cylinder.

In practice the valve block 11 may have a drain drilling aligned on plane 27 and the spool 13 will have a pair of spaced "O"-ring seals on its central land, the drilling draining any leakage past the seals from the galleries 44*b*, 47*a*. Moreover the block 11 may be formed in two halves divided on the plane 27.

It is an object of the present invention to provide a tandem valve wherein such problems are minimised or obviated.

DISCLOSURE OF THE INVENTION

In accordance with the present invention there is provided a tandem hydraulic valve comprising first and second axially aligned valve spools slidable in a valve guide to control, in use, the connection between respective ports of the valve guide, said first and second spools being formed as separate components and being axially interconnected, to move in unison, by an axial connection component, and, the interface of said first and second spools being connected to a predefined external leakage path.

Preferably said valve guide comprises first and second axially aligned and separately formed valve guide components, said first valve guide component cooperating with said first valve spool, said second valve guide component cooperating with said second valve spool, and said first and second valve guide components being held in a fixed axial relationship to one another with the axial interface of said first and second valve guide components forming part of said predefined leakage path.

Preferably said axial connection component extends through both spool components and bears against the outer axial ends of the spool components.

Desirably said axial connection component comprises an elongate sleeve which extends through the spool components and an elongate element which extends through said elongate sleeve and bears against the opposite axial ends of the sleeve.

Preferably said leakage path is visible at the exterior of the valve to provide a visual indicator of a spool failure.

Desirably said leakage path is a leakage path to atmosphere.

BRIEF DESCRIPTION OF THE DRAWINGS

In the accompanying drawings

PREFERRED MODE FOR CARRYING OUT THE INVENTION

Figure 1:
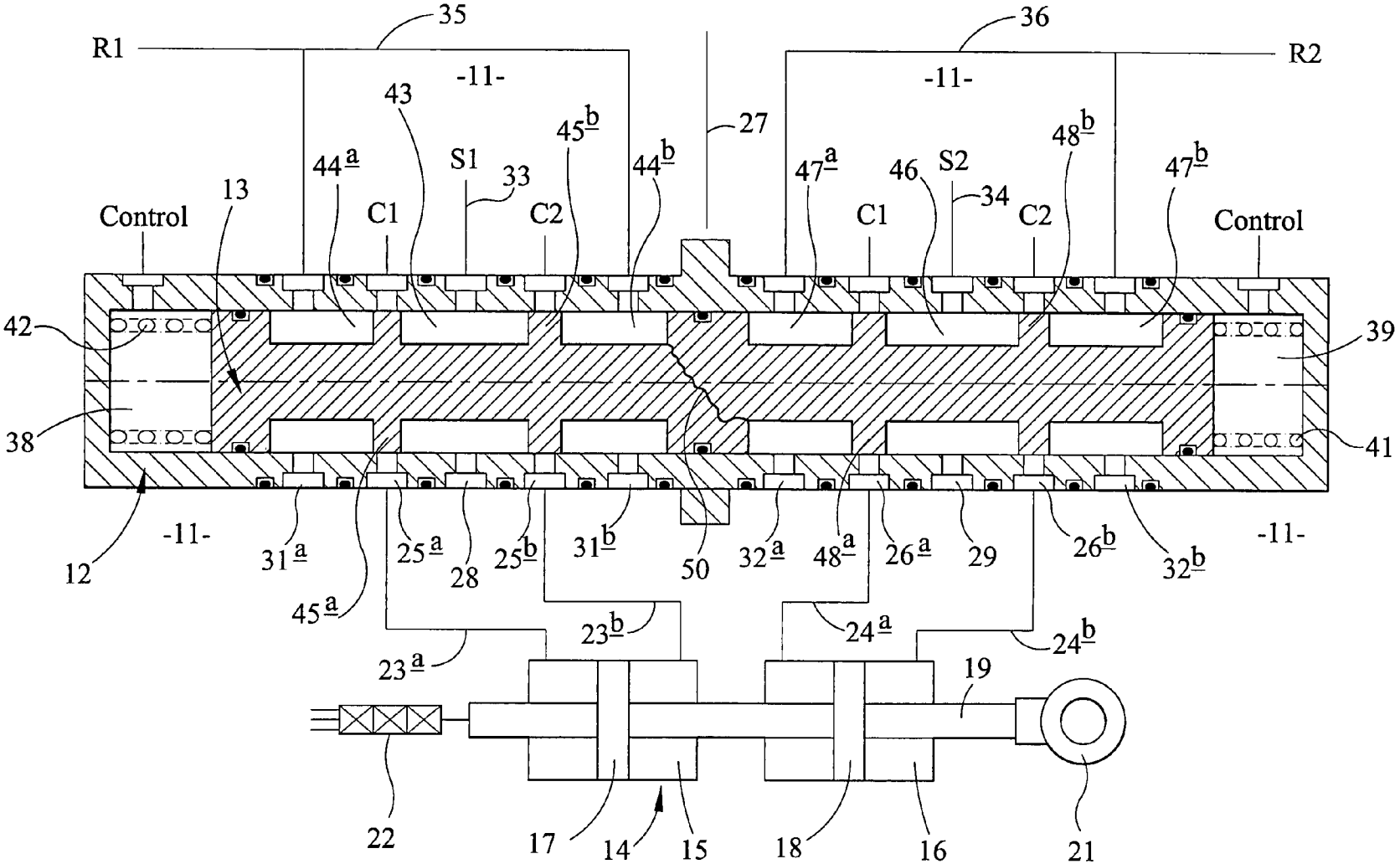
FIG. 1 is a diagrammatic axial cross-sectional view of a previously proposed form of tandem valve; and, FIG. 2 is a view similar to FIG. 1 of a tandem valve in accordance with a first example of the present invention.
Figure 2:
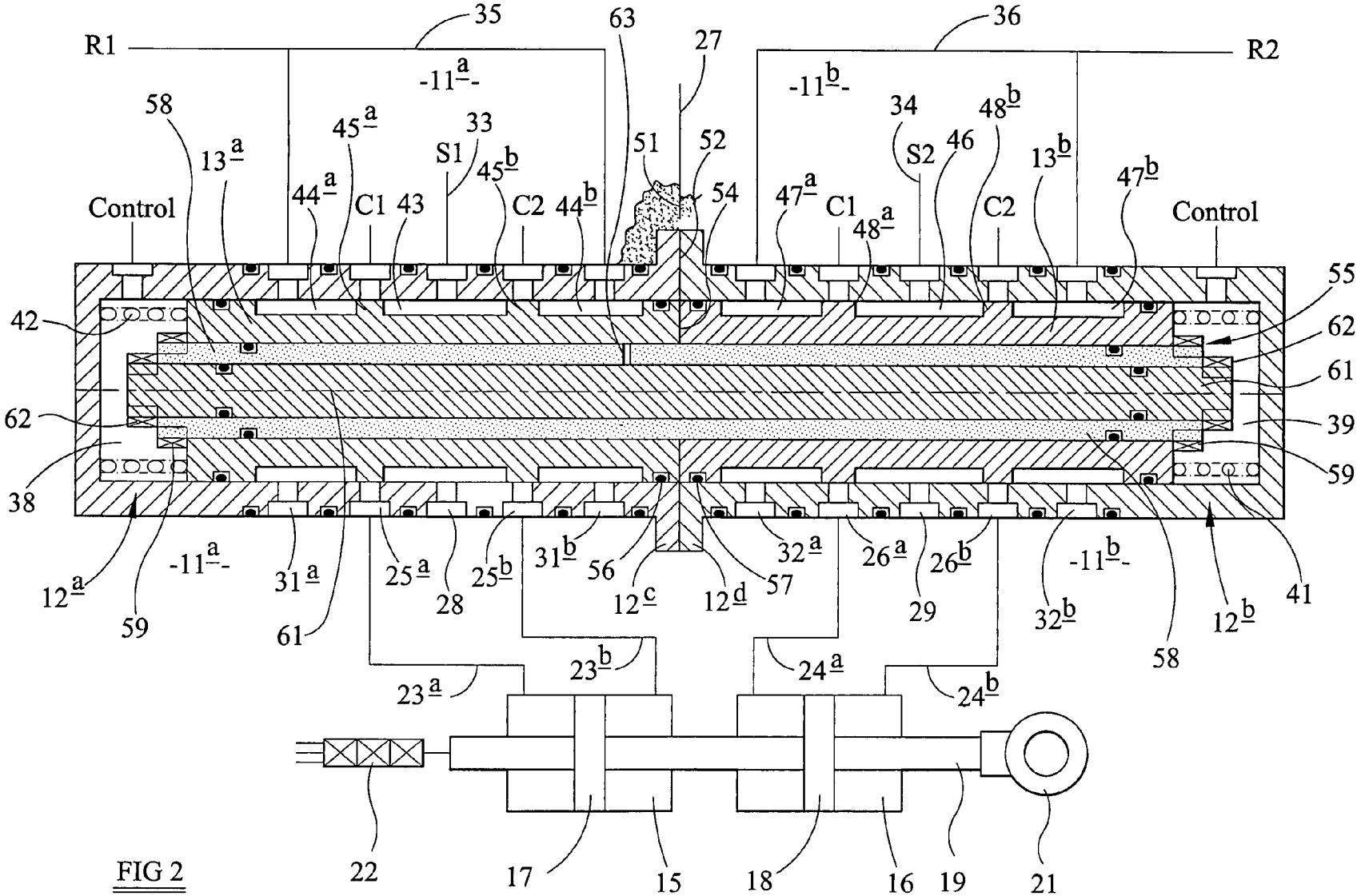

Referring now to FIG. 2, components common to the valve described above with reference to FIG. 1 carry the same reference numerals.

In FIG. 2 it can be seen that the tandem valve comprises a valve block 11 formed as two axially aligned halves 11*a*, 11*b* which abut axially at the mid-plane 27 of the tandem valve and define an interface 51 in the plane 27. Received within the valve block 11 is a valve guide 12 which is formed as two axially aligned separate components 12*a*, 12*b* and which are held in axial abutment by the block 11. The guide components 12*a*, 12*b* abut at an interface 52 disposed in the plane 27 and each of the components 12*a*, 12*b* includes adjacent to the interface 52 an integral peripheral outwardly extending flange 12*c*, 12*d*, the flanges 12*c*, 12*d* being held in facial abutment by being received within appropriately recessed regions of the end faces of the block halves 11*a*, 11*b*. The manner in which the guide halves are held axially in place is not of importance to the invention, but it will be recognised that securing the block halves 11*a*, 11*b* together locks the valve guide components 12*a*, 12*b* together so that functionally they act as a single valve guide serving both valves of the tandem valve.

The interface 51 of the block communicates with the interface 52 of the valve guide components and the interface 51 is open to atmosphere at its outer periphery. It can be seen that the ports and drillings of the valve guide 12 are as described above in relation to FIG. 1.

Slidably received within the valve guide 12*a*, 12*b* is a valve spool 13 which is defined by first and second valve spool components 13*a*, 13*b* formed separately from one another, but held in axial alignment, with their axial end faces abutting, by a securing assembly 55. The spool components 13*a*, 13*b* abut at an interface 54 disposed within the plane 27 when the spool is at the mid-point of its travel. The axially abutting end regions of the spool components 13*a*, 13*b* define a divided land equivalent to the large central land of the one-piece spool of FIG. 1. The land of the spool 13*a*, 13*b* is divided by the interface 54, and each half of the land is provided with an O-ring seal 56, 57 to seal the sliding interface of the central land of the spool with the central region of the valve guide 12*a*, 12*b*. The spacing of the seals 56, 57 is selected, in relation to the maximum throw of the spool in either direction from the central position illustrated in FIG. 2, such that neither seal rides over the interface 52 of the valve block components 12*a*, 12*b*. Thus at all times the interface 54 of the spool components 13*a*, 13*b* is hydraulically connected to the interface 52 of the guide components, and thereby connected to atmosphere by way of the interface 51 of the block halves.

It can be seen that the spool component 13*a* has galleries 43, 44*a*, 44*b* and dividing lands 45*a*, 45*b* and the spool component 13*b* similarly has galleries 46, 47*a*, 47*b* separated by lands 48*a* and 48*b*. As mentioned above the two halves of the spool 13*a*, 13*b* are rigidly interconnected so as to be axially immovable relative to one another, and thus the spool 13*a*, 13*b* operates in conjunction with the guide 12*a*, 12*b* in exactly the same manner as the spool and block of the construction shown in FIG. 1.

Each of the spool components 13*a*, 13*b* is in the form of a hollow metal sleeve, and extending through the spool components 13*a*, 13*b* is a coaxial securing sleeve 58 forming one part of the securing assembly 55 of the spool components. The sleeve 58 protrudes at its opposite axial ends from the outer ends of the components 13*a* and 13*b* respectively, and each protruding end of the sleeve 58 is externally screw-threaded, and receives a securing nut 59 which is tightened to bear against the adjacent end of the respective spool component so that the two spool components are moved axially into abutment at the interface 54, and are held in abutting engagement thereby. O-ring seals carried in external peripheral grooves of the sleeve 58 and positioned adjacent at the outer ends of the sleeve 58 seal the cylindrical interface of the sleeve 58 and the spool components 13*a*, 13*b*.

Extending through the sleeve 58 is a second component of the securing assembly 55 in the form of an elongate solid metal rod 61 opposite axial ends of which protrude beyond the opposite axial ends of the sleeve 58 and are screw-threaded to receive securing nuts 62. The securing nuts 62 are tightened against their respective abutting end faces of the sleeve 58 so that the rod 61 is placed in slight tension within the sleeve 58. 'O'-ring seals received in respective circumferential grooves in the rod 61, adjacent its opposite axial ends, seal the cylindrical interface of the rod 61 and the sleeve 58. A radial through bore 63 in the wall of the sleeve 58 places the cylindrical interface of the sleeve 58 and the spool components 13*a*, between the respective O-ring seals, in communication with the cylindrical interface of the rod 61 and the sleeve 58 between their 'O'-ring seals.

During normal operation of the valve illustrated in FIG. 2 the spool assembly consisting of the components 13*a*, 13*b* together with the securing assembly 55 operates as a single unitary component, and the operation of the two separate control valves defined by the tandem valve operates exactly as described above with reference to FIG. 1. However, the failure mode of the spool 13 of the tandem valve described with reference to FIG. 1, in which a fracture line joins the gallery 44*b* and the gallery 47*a*, cannot occur in the valve of FIG. 2 since the galleries 44*b* and 47*a* are formed in separate spool components. Fracture of the spool component 13*a* at the inner-most end of the gallery 44*b* will connect gallery 44*b* with the drain interface 51 by way of fluid leakage along the cylindrical interface of the sleeve 58 and the spool component 13*a*, the interface 54 of the spool components, and the interface 52 of the valve block components. Thus the gallery 44*b* would leak to atmosphere at the exterior of the block 11. A similar fracture of the spool component 13*b* would connect the gallery 47*a* to the drain interface 51 by way of the interface of the sleeve 58 and the spool component 13*b*, the interface 54, and the interface 52. Thus fluid from the gallery 47*a* would flow to atmosphere at the block exterior, and not to the gallery 44*b*. If necessary the interfaces 54, 52 and 51 can be relieved, by radial grooves in their faces, to ensure that there is relatively low flow resistance in the path to atmosphere.

In the unlikely event of a simultaneous fracture of the spool components 13*a* and 13*b* it is most unlikely that there would be cross contamination, since pressurised fluid from the galleries 44*b*, 47*a* will flow preferentially to atmosphere.

As mentioned previously, in relation to FIG. 1, it is crucial that the two spool components 13*a*, 13*b* move as one, so that they control their respective actuator cylinders in synchronism. The structural integrity of the spool assembly in FIG. 2 is maintained by the rod 61 in the event of fracture of the sleeve 58, and by the sleeve 58 in the event of fracture of the rod 61. Moreover, should there be leakage into the cylindrical interface of the sleeve 58 and the spool components, 13*a*, 13*b*, for example from the chambers 38 and 39, then that leakage will flow to atmosphere by way of the interface 51. Similarly, in the event of leakage along the cylindrical interface of the rod 61 and the sleeve 58, then that leakage can find its way to the interface 51 by way of the radial through bore 63 of the sleeve 58.

It will be recognised that leakage to atmosphere at the exterior of the interface 51 will be readily apparent during servicing and visual inspections and will alert observers to the probability of a valve fault such as a spool fracture.

If a single part block is to be used then the block will have an externally vented gallery or annular recess communicating in use with the interface 52. Moreover it is possible that a one-piece valve guide 12 could be utilised with a two part spool 13 and in such a construction the guide 12 will have a gallery or annular recess communicating with the interface 54 of the spool and vented to the exterior of the valve block 11 so that a leak is visible.

In all arrangements of the invention the hydraulic circuits of the first and second piston and cylinder arrangements 15, 17; 16, 18 are maintained isolated from one another even in a spool fracture fault situation. In such a fault situation leakage of hydraulic fluid (usually oil) at the exterior of the valve block will alert service personnel to the fault, while permitting the undamaged half of the valve to function normally to control its respective cylinder of the dual-tandem actuator 14 so that notwithstanding a fault in one of the spool components 13*a*, 13*b* control over the associated flight control surface or other component driven by the actuator 14 is maintained.

It will be recognised that in some applications the nuts 59 bearing against the outer axial ends of the spool components 13*a*, 13*b*, and also the nuts 62 bearing against the ends of the sleeve 58, may be replaced by alternative load bearing securing means for example integral heads or flanges formed after assembly of the components or welds, conveniently laser welds, also formed after assembly.

The invention claimed is:

1. A tandem hydraulic valve comprising first and second axially aligned valve spools, a valve guide slidably receiving said valve spools to control, in use, the connection between respective ports of the valve guide, said first and second spools being formed as separate components and being axially interconnected, to move in unison, by an axial connection component, and, the interface of said first and second spools being connected to a predefined, external, hydraulic fluid leakage path.

2. A tandem hydraulic valve as claimed in claim 1 wherein said valve guide comprises first and second axially aligned and separately formed valve guide components, said first valve guide component cooperating with said first valve spool, said second valve guide component cooperating with said second valve spool, and said first and second valve guide components being held in a fixed axial relationship to one another with the axial interface of said first and second valve guide components forming part of said predefined leakage path.

3. A tandem hydraulic valve as claimed in claim 1 wherein said axial connection component extends through both of said first and second spool components and bears against the outer axial ends of the spool components.

4. A tandem hydraulic valve as claimed in claim 1 wherein said axial connection component comprises an elongate sleeve which extends through the spool components and an elongate element which extends through said elongate sleeve and bears against the opposite axial ends of the sleeve.

5. A tandem hydraulic valve as claimed in claim 1 wherein said leakage path is visible at the exterior of the valve to provide a visual indicator of a spool failure.

6. A tandem hydraulic valve as claimed in claim 1 wherein said leakage path is a leakage path to atmosphere.

7. A tandem hydraulic valve comprising, first and second axially aligned valve spools, a valve guide slidably receiving said valve spools to control, in use, the connection between respective ports of the valve guide, said first and second spools being formed as separate components and being axially interconnected, to move in unison, by an axial connection component including an elongate sleeve which extends through the spool components and an elongate element which extends through said elongate sleeve and bears against the opposite axial ends of the sleeve, said valve guide comprising first and second axially aligned and separately formed valve guide components, said first valve guide component cooperating with said first valve spool, said second valve guide component cooperating with said second valve spool, and, said first and second valve guide components being held in a fixed axial relationship to one another with the axial interface of said first and second valve guide components forming part of a predefined hydraulic fluid leakage path, to which the interface of said first and second spools is exposed.

* * * * *